US012741191B1

(12) United States Patent
Zhu

(10) Patent No.: US 12,741,191 B1
(45) Date of Patent: Sep. 22, 2026

(54) AUTOMATIC SENSING SCORING METHOD AND DEVICE FOR CORNHOLE GAME, EQUIPMENT AND MEDIUM

(71) Applicant: Yunhui Zhu, Fuzhou (CN)

(72) Inventor: Yunhui Zhu, Fuzhou (CN)

( * ) Notice: Subject to any disclaimer, the term of this patent is extended or adjusted under 35 U.S.C. 154(b) by 0 days.

(21) Appl. No.: 19/360,127

(22) Filed: Oct. 16, 2025

(51) Int. Cl.
*A63B 71/06* (2006.01)
*A63B 24/00* (2006.01)

(52) U.S. Cl.
CPC ..... *A63B 71/0669* (2013.01); *A63B 71/0605* (2013.01); *A63B 2024/0037* (2013.01)

(58) Field of Classification Search
CPC ..... A63B 71/0669; A63B 71/0605; A63B 2024/0037
See application file for complete search history.

(56) References Cited

U.S. PATENT DOCUMENTS 5,015,840 A * 5/1991 Blau ..... F16P 3/144 250/221
7,102,119 B1 * 9/2006 Breslow ..... A63B 67/002 250/221
12,115,425 B1 * 10/2024 Jones ..... A63B 71/0622
12,364,917 B1 * 7/2025 Margareten ..... A63B 71/0622
2020/0298079 A1 * 9/2020 Mullins ..... A63B 71/0669
2022/0096909 A1 * 3/2022 Russell ..... H05B 47/13
2024/0075365 A1 * 3/2024 Rockett ..... A63B 71/023
2025/0325891 A1 * 10/2025 Dost ..... B32B 3/266

FOREIGN PATENT DOCUMENTS

CN 101382405 A 3/2009
CN 208212489 U 12/2018
TW M351098 U 2/2009
WO WO-2009130474 A1 * 10/2009 ..... A63B 71/0669

* cited by examiner

*Primary Examiner* — Ankit B Doshi
(74) *Attorney, Agent, or Firm* — Nitin Kaushik

(57) ABSTRACT

Embodiments of the present disclosure belong to the field of automatic scoring and relate to an automatic sensing scoring method for a cornhole game, including: continuously transmitting infrared light beams at relative positions of each of target holes and receiving the infrared light beams in real time; when it is detected that the infrared light beams are shielded, amplifying an electrical signal output by a receiving end through an operational amplifier, and suppressing high-frequency interference through a low-pass filter with a preset cutoff frequency while retaining envelope changes of a shielding event to obtain a scoring trigger signal; converting, by a microprocessor, the scoring trigger signal into a corresponding score according to a preset "hole-score" mapping table, outputting the updated cumulative score in real time through a digital display screen. The present disclosure further provides an automatic sensing scoring device for a cornhole game, equipment and a medium.

8 Claims, 4 Drawing Sheets

AUTOMATIC SENSING SCORING METHOD AND DEVICE FOR CORNHOLE GAME, EQUIPMENT AND MEDIUM

TECHNICAL FIELD

The present disclosure relates to technical field of automatic scoring, and in particular to an automatic sensing scoring method and device for a cornhole game, equipment and a medium.

BACKGROUND

Hole-cornhole games such as sandbag throwing are very popular in outdoor leisure and campus activities, but a current mainstream scoring method still relies on manual recording or use of electronic scoring devices with complex structures, high costs, and sensitivity to ambient light and vibration.

In a scenario of fast-cornhole games, these traditional solutions can hardly simultaneously meet the core requirement of "real-time, accurate, and reliable outdoor automatic scoring": Manual scoring is inefficient and prone to errors; common mechanical-contact or visual recognition devices are often affected by direct sunlight, sandbag impact and equipment vibration, resulting in misjudgments, missed judgments and frequent maintenance, making it difficult to achieve stable application on lightweight, portable game boards.

Therefore, the industry urgently needs an automatic scoring technology with a simple structure, strong anti-interference ability, and the ability to work continuously outdoors, so as to instantly determine a hole and update a score at the moment of throwing, thereby improving fairness, smoothness and user experience of the game.

SUMMARY

A purpose of embodiments of the present disclosure is to provide an automatic sensing scoring method and device for a cornhole game, computer equipment and a medium to solve the technical problems of traditional manual scoring which is prone to errors and slow response.

In order to solve the above technical problems, the embodiment of the present disclosure provides an automatic sensing scoring method for a cornhole game, which adopts the following technical solution:

An automatic sensing scoring method for a cornhole game, applied to a game board provided with a plurality of target holes, including the following steps:

- continuously transmitting infrared light beams at relative positions of each of target holes and receiving the infrared light beams in real time;
- when it is detected that the infrared light beams are shielded, amplifying an electrical signal output by a receiving end through an operational amplifier, and suppressing high-frequency interference through a low-pass filter with a preset cutoff frequency while retaining envelope changes of a shielding event to obtain a scoring trigger signal;
- converting, by a microprocessor, the scoring trigger signal into a corresponding score according to a preset "hole-score" mapping table and adding the score to a cumulative score of a current contestant; and
- during a preset scoring period, outputting the updated cumulative score in real time through a digital display screen.

Further, after the step of continuously transmitting infrared light beams at relative positions of each of target holes and receiving the infrared light beams in real time, the method further includes:

- recording a baseline level in an unshielded state; and
- updating a shielding judgment threshold regularly to compensate for ambient light changes and control a misjudgment rate within a preset reliability index.

Further, a transmitting end and the receiving end of the infrared light beams are fixed by an elastic shock-proof bracket including a rubber shock-absorbing pad and an adjustable optical axis kit to offset an optical axis deviation caused by a throwing impact.

Further, in the step of converting, by a microprocessor, the scoring trigger signal into a corresponding score according to a preset "hole-score" mapping table and adding the score to a cumulative score of a current contestant, when generating the score, the microprocessor further drives a ring LED and/or buzzer according to a preset visual and/or auditory prompt mode to prompt a scoring event.

Further, after the step of during a preset scoring period, outputting the updated cumulative score in real time through a digital display screen, the method further includes:

- sending the cumulative score periodically to a mobile terminal in the form of a Bluetooth Low Energy broadcast packet to support remote statistics and sharing.

Further, in the step of when it is detected that the infrared light beams are shielded, amplifying an electrical signal output by a receiving end through an operational amplifier, and suppressing high-frequency interference through a low-pass filter with a preset cutoff frequency while retaining envelope changes of a shielding event to obtain a scoring trigger signal, the method further includes:

- after shielding is detected, writing a corresponding trigger event into a circular queue; and
- performing circular queue parallel processing on the scoring trigger signals of the plurality of target holes, so that an overall scoring delay is kept within a delay range that meets real-time requirements.

Further, the method further includes:

- when it is detected that a battery voltage is lower than a preset threshold, controlling the digital display screen to prompt at a preset flash frequency and suspending a scoring process until a battery is replaced or restored to a normal voltage.

In order to solve the above technical problems, the embodiment of the present disclosure further provides an automatic sensing scoring device for a cornhole game, which adopts the following technical solution:

An automatic sensing scoring device for a cornhole game, including:

- a transmitting and receiving module, configured to continuously transmit infrared light beams at relative positions of each of target holes and receive the infrared light beams in real time;
- an amplification module, configured to, when it is detected that the infrared light beams are shielded, amplify an electrical signal output by a receiving end through an operational amplifier, and suppress high-frequency interference through a low-pass filter with a preset cutoff frequency while retaining envelope changes of a shielding event to obtain a scoring trigger signal;
- an accumulation module, configured to, convert, by a microprocessor, the scoring trigger signal into a corresponding score according to a preset "hole-score" mapping table and add the score to a cumulative score of a current contestant; and an output module, configured to, during a preset scoring period, output the updated cumulative score in real time through a digital display screen.

In order to solve the above technical problems, the embodiment of the present disclosure further provides computer equipment, which adopts the following technical solution:

Computer equipment, including a memory and a processor, wherein the memory stores computer-readable instructions therein, and when executing the computer-readable instructions, the processor implements the steps of the automatic sensing scoring method for a cornhole game as described above.

In order to solve the above technical problems, the embodiment of the present disclosure further provides a computer-readable storage medium, which adopts the following technical solution:

A computer-readable storage medium, wherein the computer-readable storage medium stores computer-readable instructions therein, and when executed by a processor, the computer-readable instructions implement the steps of the automatic sensing scoring method for a cornhole game as described above.

Compared with the prior art, the embodiments of the present disclosure have the following beneficial effects:

The automatic sensing scoring method for a cornhole game disclosed in the present disclosure includes: continuously transmitting infrared light beams at relative positions of each of target holes and receiving the infrared light beams in real time; when it is detected that the infrared light beams are shielded, amplifying an electrical signal output by a receiving end through an operational amplifier, and suppressing high-frequency interference through a low-pass filter with a preset cutoff frequency while retaining envelope changes of a shielding event to obtain a scoring trigger signal; converting, by a microprocessor, the scoring trigger signal into a corresponding score according to a preset "hole-score" mapping table and adding the score to a cumulative score of a current contestant; and during a preset scoring period, outputting the updated cumulative score in real time through a digital display screen. According to the present disclosure, the infrared light beams are continuously transmitted at the relative position of each of the target holes and received in real time; the signal is amplified and filtered when shielding is detected; and the microprocessor makes a judgment and accumulates the score according to preset mapping rules. Finally, results are output in real time on the digital display screen, which realizes non-contact automatic scoring during a throwing process, thereby effectively avoiding defects of traditional manual scoring which is prone to errors and slow response.

BRIEF DESCRIPTION OF DRAWINGS

In order to more clearly illustrate the solutions in this disclosure, a brief introduction will be given below to the drawings required for use in the description of the embodiments of this disclosure. Obviously, the drawings described below are some embodiments of this disclosure. For those of ordinary skill in the art, other drawings can be obtained based on these drawings without any creative work.

DETAILED DESCRIPTION OF THE EMBODIMENTS

In order to enable those skilled in the art to better understand solutions of the present disclosure, the technical solutions in embodiments of the present disclosure will be clearly and completely described below in conjunction with the accompanying drawings.

Figure 1:
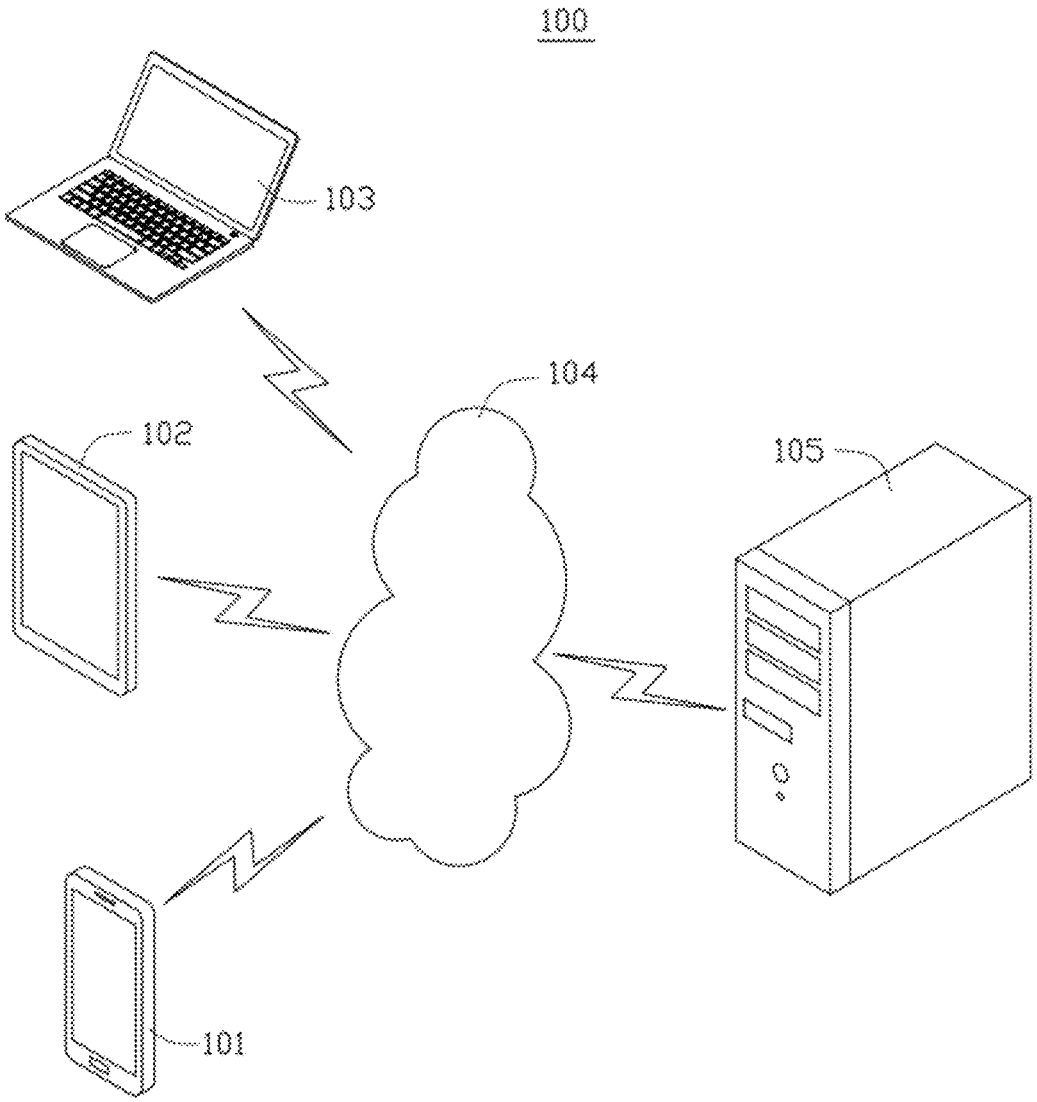
FIG. 1 is a diagram of an exemplary system architecture in which the present disclosure may be applied.

As shown in FIG. 1, a system architecture 100 may include terminal devices 101, 102, and 103, a network 104, and a server 105. The network 104 is used as a medium for providing a communication link between the terminal devices 101, 102, 103 and the server 105. The network 104 may include various connection types, such as wired, wireless communication links, fiber optic cables, and the like.

A user may use the terminal devices 101, 102, 103 to interact with server 105 via the network 104 to receive or send messages, etc. Various communication client applications may be installed on the terminal devices 101, 102, and 103, such as web browser applications, shopping applications, search applications, instant messaging tools, email clients, social platform software, etc.

The terminal devices 101, 102, and 103 may be various electronic devices with display screens and supporting web browsing, including but not limited to smartphones, tablet computers, e-book readers, Moving Picture Experts Group Audio Layer III (MP3) players, Moving Picture Experts Group Audio Layer IV (MP4) players, laptop computers, desktop computers, and the like.

The server 105 may be a server that provides various services, such as a background server that provides support for web pages displayed on the terminal devices 101, 102, and 103.

It should be noted that the automatic sensing scoring method for a cornhole game provided by the embodiment of the present disclosure is generally executed by a server. Accordingly, the automatic sensing scoring device for a cornhole game is generally provided in the server.

It should be understood that the number of terminal devices, networks and servers in FIG. 1 is merely illustrative. Depending on the implementation requirements, there can be any number of terminal devices, networks, and servers.

Figure 2:
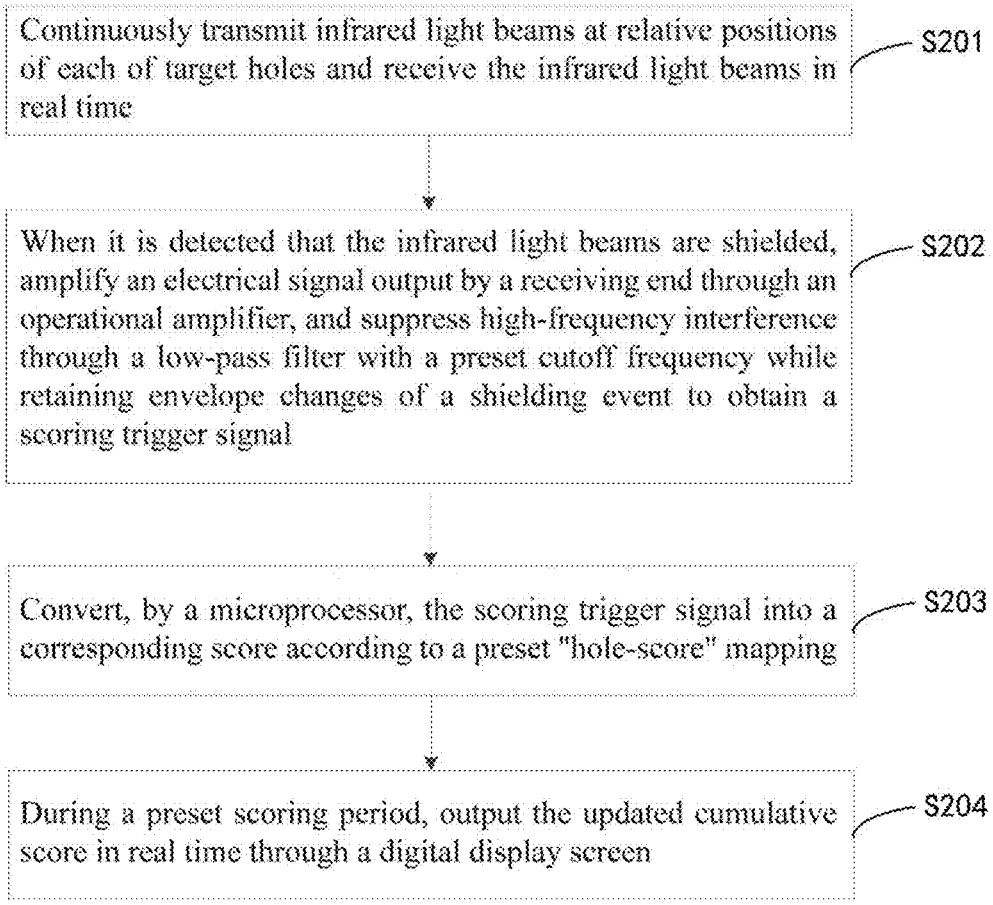
FIG. 2 is a flowchart of an embodiment of an automatic sensing scoring method for a cornhole game according to the present disclosure.

Continuing to refer to FIG. 2, a flowchart of an embodiment of an automatic sensing scoring method for a cornhole game according to the present disclosure is shown. The automatic sensing scoring method for a cornhole game includes the following steps:

Step S201: continuously transmitting infrared light beams at relative positions of each of target holes and receiving the infrared light beams in real time.

In this embodiment, an electronic device (eg. the server shown in FIG. 1) on which the automatic sensing scoring method for a cornhole game is running can transmit or receive data via a wired connection or a wireless connection. It should be noted that the above-mentioned wireless connection methods may include but are not limited to 3G/4G/

5G connection, WiFi connection, Bluetooth connection, WiMAX connection, Zigbee connection, ultra wideband (UWB) connection, and other wireless connection methods currently known or to be developed in the future.

In this embodiment, a 940 nm wavelength infrared transmitting tube and a paired PIN type infrared receiving tube are fixed opposite each hole on the game board, and the center lines of the two are precisely aligned with the axis of the hole. To ensure alignment accuracy and offset the shock offset caused by a sandbag impact, the transmitting tube and the receiving tube are installed together on an adjustable optical axis bracket with a rubber shock-absorbing pad; the transmitting tube works continuously, transmitting the pulsed infrared light beams using a 38 kHz carrier modulation method, while the receiving tube monitors the return signal strength in real time.

Step S202: when it is detected that the infrared light beams are shielded, amplifying an electrical signal output by a receiving end through an operational amplifier, and suppressing high-frequency interference through a low-pass filter with a preset cutoff frequency while retaining envelope changes of a shielding event to obtain a scoring trigger signal In this embodiment, when the sandbag perforates the board and shields the light beams, the photoelectric current output by the receiving tube drops suddenly, and is converted and amplified into a millivolt voltage signal by the pre-transimpedance operational amplifier. To suppress high-frequency interference such as ambient light flicker, mobile phone flashes, or LED revolving lights, the voltage signal is then fed into a second-order passive RC low-pass filter with a cutoff frequency set in the range of 300 Hz to 1 kHz. This frequency band covers the demodulated envelope of a 38 kHz pulse and reliably filters out noise components above 1 kHz, thereby obtaining the scoring trigger signal with clear edges and jitter less than ±5 ms.

Step S203: converting, by a microprocessor, the scoring trigger signal into a corresponding score according to a preset "hole-score" mapping table and adding the score to a cumulative score of a current contestant.

In this embodiment, the microprocessor (such as a Cortex-M0+ core) captures the rising edge of the trigger signal through an interrupt port and calls a table lookup program to retrieve the "hole-score" mapping entry in the EEPROM. The mapping table presets the score weights corresponding to different hole diameters or different numbers, such as 5 points for a center hole, 3 points for an outer ring hole, and 1 point for a corner auxiliary hole. The processor writes the retrieved score into a local variable of the contestant to which the current queue belongs and immediately performs an unsigned addition operation to accumulate the score, and then refreshes the total score stored in the on-chip RAM. To allow viewers to see results almost instantly, the main loop sets a 100 ms upper limit on the scoring period: If triggering is made for multiple times within a cycle, the microprocessor first stores all increments in SRAM, and then completes the summation and display update at the end of the cycle. This not only avoids flickering, but also ensures that there will be no display tearing or scoring omissions when multiple people throw consecutively.

Step S204: during a preset scoring period, outputting the updated cumulative score in real time through a digital display screen.

In this embodiment, the score data is sent to a seven-segment LED driver chip via a 4-bit parallel port or $I^2C$ bus, with a refresh time of approximately 1.5 ms. Therefore, from the light shielding by the sandbag to the stable display of the new score, the response time of a whole machine is controlled within the range of 20 ms-40 ms, which is far below the perceptible limit of 100 ms of human eyes, realizing "real-time output". In high sunlight or dimly lit environments, the transmitting end current and display driver PWM duty cycle will be automatically adjusted by the microprocessor based on the photoresistor sampling results to maintain signal margin and readability.

According to the present disclosure, the infrared light beams are continuously transmitted at the relative position of each of the target holes and received in real time; the signal is amplified and filtered when shielding is detected; and the microprocessor makes a judgment and accumulates the score according to preset mapping rules. Finally, results are output in real time on the digital display screen, which realizes non-contact automatic scoring during a throwing process, thereby effectively avoiding defects of traditional manual scoring which is prone to errors and slow response.

In some optional implementations of this embodiment, after the above step of continuously transmitting infrared light beams at relative positions of each of target holes and receiving the infrared light beams in real time, the method further includes:

recording a baseline level in an unshielded state; and updating a shielding judgment threshold regularly to compensate for ambient light changes and control a misjudgment rate within a preset reliability index.

In this embodiment, to improve the adaptability and accuracy of infrared detection, this embodiment measures the baseline level output by each infrared receiver in an unshielded state during the initial setting phase, that is, the reference signal strength at the receiving end when there is no object shielding it. This baseline is used as a comparison standard for subsequent determination of whether a shielding event occurs. Since ambient light (such as sunlight, lighting, reflection, etc.) may change over time, always using a fixed threshold will lead to misjudgment or missed judgment. Therefore, the system sets up an automatic calibration mechanism. For example, the current baseline level is remeasured every 30 seconds, and the shielding judgment threshold is adaptively updated accordingly to ensure that the accuracy of the filtered signal judgment is maintained at a high level and the misjudgment rate is stably controlled within 1%. This dynamic threshold update process runs in the background and does not affect the main circular real-time scoring process.

This disclosure achieves dynamic compensation for changes in ambient light by introducing two adaptive calibration sub-steps, namely "recording a baseline level in an unshielded state" and "updating a threshold periodically" after the infrared detection step, so that the system can still accurately identify shielding events in strong outdoor light, at night or in environments with frequent changes in light sources, effectively reducing the probability of misjudgment and missed judgment, and controlling the false trigger rate to below 1%, thereby improving reliability and adaptability of the system.

In some optional implementations of this embodiment, a transmitting end and the receiving end of the infrared light beams are fixed by an elastic shock-proof bracket including a rubber shock-absorbing pad and an adjustable optical axis kit to offset an optical axis deviation caused by a throwing impact.

In this embodiment, the transmitting end and the receiving end of the infrared light beams are installed at opposite positions of each target hole and are fixed by a rationally structured elastic shock-proof bracket. The bracket structure includes the rubber shock-absorbing pad for absorbing the vibration generated by the sandbag hitting the game board, and the optical axis kit with a locking thread or dial adjustment mechanism for fine-tuning the relative angle of a transmitter and a receiver. This structure can maintain the optical axis alignment of the infrared tube for a long time, avoiding misalignment caused by continuous shocking or transportation, thereby improving the stability and long-term reliability of shielding detection. It is particularly suitable for use outdoors or in scenarios where frequent transportation is required.

In the present disclosure, the transmitting end and the receiving end of the infrared light beams are fixed by using the elastic shock-proof bracket including the rubber shock-absorbing pad and the adjustable optical axis kit, thereby achieving buffering and absorption of structural shocking caused by throwing impact and active correction of optical axis offset, and thus maintaining the stability of beam alignment and shielding recognition, and improving long-term use accuracy and mechanical stability in situations of intense multi-person competitions or frequent equipment movement.

In some optional implementations of this embodiment, in the step of converting, by a microprocessor, the scoring trigger signal into a corresponding score according to a preset "hole-score" mapping table and adding the score to a cumulative score of a current contestant, when generating the score, the microprocessor further drives a ring LED and/or buzzer according to a preset visual and/or auditory prompt mode to prompt a scoring event.

In this embodiment, after the microprocessor completes the scoring and determines the score, the microprocessor can also provide instant feedback to the user in visual and auditory ways. Specifically, when a contestant scores, the processor immediately drives the ring LED light strip fixed to the edge of the target hole to flash twice and controls the buzzer to transmit a short beep. This prompt mechanism can achieve clear and intuitive feedback without relying on external display, allowing the thrower and the audience to know the scoring status at the first time. This feedback mechanism not only enhances user participation and immersion, but also reduces disputes caused by unclear scores in scenarios where multiple people throw continuously.

The present disclosure achieves instant visual and auditory feedback for players and spectators by controlling the flashing of the LED light strip and the sounding of the buzzer by the microprocessor when the scoring event is triggered, avoiding the delayed perception of relying solely on digital display, enhancing the on-site interactive experience, and improving the fun and viewing experience of the game. The method also assists in confirming the scoring status and reducing disputes.

In some optional implementations of this embodiment, after the step of during a preset scoring period, outputting the updated cumulative score in real time through a digital display screen, the method further includes:

sending the cumulative score periodically to a mobile terminal in the form of a Bluetooth Low Energy broadcast packet to support remote statistics and sharing.

In this embodiment, a remote data synchronization function is also provided. After the current score is updated and output on the digital display screen, the system also periodically sends the score data in the form of a broadcast packet to a paired mobile terminal, such as a smartphone or a competition management tablet, via a Bluetooth Low Energy (BLE) protocol. This function facilitates the synchronization of scoring information to large screens, public display systems or recording terminals during competitions, enabling more advanced competition management and data statistics, and also provides basic data support for the user to generate scoring curves, historical playback and other functions.

The present disclosure realizes wireless remote synchronization of scoring data by sending the scoring data to the mobile terminal in the form of Bluetooth Low Energy broadcast after local scoring is completed, thereby supporting access to mobile phone applications, event management platforms or large-screen public display systems, and improving the application flexibility and information sharing capabilities of the device in multiple scenarios such as official competitions, training statistics and home entertainment.

In some optional implementations of this embodiment, in the step of when it is detected that the infrared light beams are shielded, amplifying an electrical signal output by a receiving end through an operational amplifier, and suppressing high-frequency interference through a low-pass filter with a preset cutoff frequency while retaining envelope changes of a shielding event to obtain a scoring trigger signal, the method further includes:

after shielding is detected, writing a corresponding trigger event into a circular queue; and performing circular queue parallel processing on the scoring trigger signals of the plurality of target holes, so that an overall scoring delay is kept within a delay range that meets real-time requirements.

In this embodiment, for the multi-hole detection scenario, in order to prevent detection interference of each target hole and competition for processor resources, this embodiment encapsulates the trigger event of each hole into a task object after the shielding signal appears, and writes the same into a timestamp-based circular queue. The microprocessor uses a polling mechanism to take events out of the queue in sequence, and completes the amplification, filtering, scoring and output operations corresponding to the event in sequence. This queue-based scheduling not only allows multiple holes to respond to throwing events simultaneously, but also prevents a certain hole from monopolizing resources due to continuous shielding, thereby compressing the overall average scoring delay within a preset delay range (such as 20 ms), meeting the dual requirements of real-time and multi-channel processing.

The present disclosure writes the event into the circular queue after the infrared detection generates a shielding signal, and processes the trigger signals of multiple holes in parallel in a polling manner, thereby achieving high-concurrency detection and balanced processing of multiple target holes, effectively avoiding signal shielding and response delays, controlling the overall scoring delay within the range that meets the real-time requirements, and ensuring that the system can still maintain real-time response and fairness in multi-user or fast continuous-throwing scenarios.

In some optional implementations of this embodiment, the above method further includes:

when it is detected that a battery voltage is lower than a preset threshold, controlling the digital display screen to prompt at a preset flash frequency and suspending a scoring process until a battery is replaced or restored to a normal voltage.

In this embodiment, in order to ensure the stability of the entire system and the safety of user operations, this embodiment further integrates a power monitoring function. When the system detects that the current battery voltage is lower than the preset threshold (such as a 3.3V system drops to 2.8V), it is judged to be in a low-power state. At this time, the microprocessor controls the display screen to flash at a preset flash frequency (for example, 1 Hz frequency) and suspends the scoring-related processes to avoid misjudgment or data loss due to the unstable voltage. This mechanism will continue to operate until the user replaces the battery with a new one, or automatically reset after the voltage returns to a normal range. Through this design, users can promptly detect low-battery risks and ensure that the system continues to operate reliably.

The present disclosure achieves active prompts for a low-battery state and automatic protection against erroneous scoring by controlling the digital display to flash and suspend scoring when the battery voltage is lower than the threshold, avoiding data errors or equipment failures caused by the system continuing to run when the battery is low, and improving user maintenance convenience and the safety and stability of system operation.

Those of ordinary skill in the art will understand that all or part of the processes in the above-mentioned embodiment methods can be implemented by instructing related hardware through computer-readable instructions. The computer-readable instructions may be stored in a computer-readable storage medium. When executed, the program can include the processes of the embodiments of the above-mentioned methods. The aforementioned storage medium may be a non-volatile storage medium such as a magnetic disk, an optical disk, a read-only memory (ROM), or a random access memory (RAM).

It should be understood that although the steps in the flowchart of the accompanying drawings are displayed in sequence as indicated by the arrows, these steps are not necessarily executed in the order indicated by the arrows. Unless otherwise specified herein, there is no strict order restriction on the execution of these steps and they may be executed in other orders. Moreover, at least part of the steps in the flowchart of the accompanying drawings may include multiple sub-steps or multiple stages. These sub-steps or stages are not necessarily executed at the same time, but can be executed at different time. The execution order of these sub-steps or stages is not necessarily sequential, but can be executed in turn or alternately with other steps or at least part of the sub-steps or stages of other steps.

Figure 3:
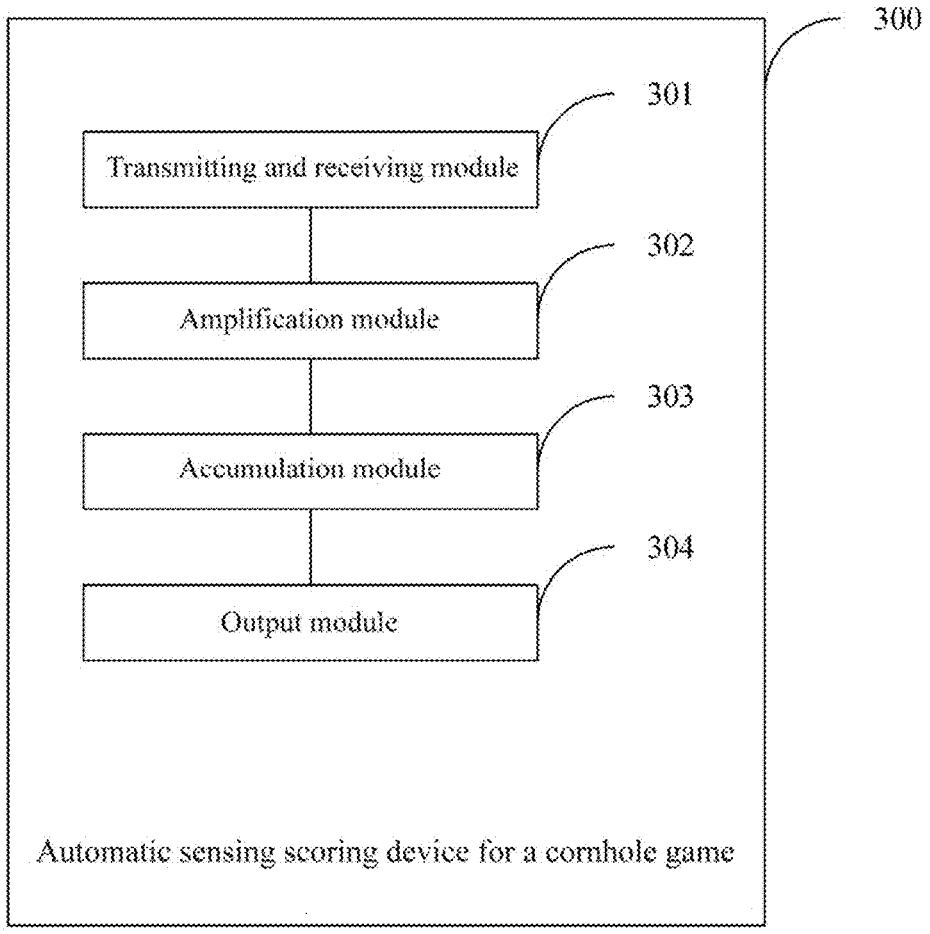
FIG. 3 is a schematic structural diagram of an embodiment of an automatic sensing scoring device for a cornhole game according to the present disclosure.

With further reference to FIG. 3, as implementation of the method shown in FIG. 2, the present disclosure provides an embodiment of an automatic sensing scoring device for a cornhole game. This system embodiment corresponds to the method embodiment shown in FIG. 2, and the system can be specifically applied to various electronic devices.

As shown in FIG. 3, the automatic sensing scoring device 300 for a cornhole game according to this embodiment includes: a transmitting and receiving module 301, an amplification module 302, an accumulation module 303, and an output module 304, wherein:

the transmitting and receiving module 301 is configured to continuously transmit infrared light beams at relative positions of each of target holes and receive the infrared light beams in real time;

the amplification module 302 is configured to, when it is detected that the infrared light beams are shielded, amplify an electrical signal output by a receiving end through an operational amplifier, and filter out noise through an active low-pass filter with a cutoff frequency of 300 Hz-1000 Hz to obtain a scoring trigger signal;

the accumulation module 303 is configured to, convert, by a microprocessor, the scoring trigger signal into a corresponding score according to a preset "hole-score" mapping table and add the score to a cumulative score of a current contestant; and the output module 304 is configured to output the updated cumulative score in real time through a digital display screen when a scoring period is no longer than 100 ms.

According to the automatic sensing scoring device for a cornhole game provided by the present disclosure, the infrared light beams are continuously transmitted at the relative position of each of the target holes and received in real time; the signal is amplified and filtered when shielding is detected; and the microprocessor makes a judgment and accumulates the score according to preset mapping rules. Finally, results are output in real time on the digital display screen, which realizes non-contact automatic scoring during a throwing process, thereby effectively avoiding defects of traditional manual scoring which is prone to errors and slow response.

Figure 4:
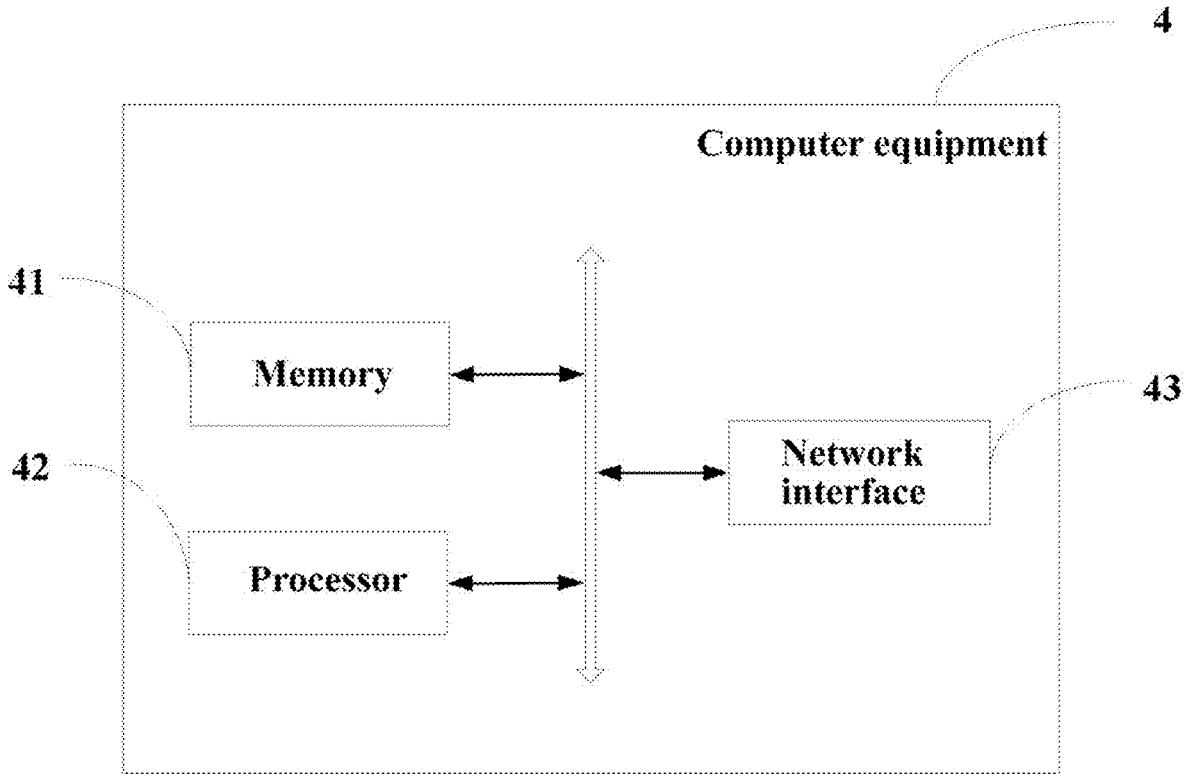
FIG. 4 is a schematic structural diagram of an embodiment of computer equipment according to the present disclosure.

In order to solve the above technical problems, an embodiment of the present disclosure further provides computer equipment. Please refer to FIG. 4 for details. FIG. 4 is a basic structural block diagram of computer equipment according to this embodiment.

The computer equipment 4 includes a memory 41, a processor 42, and a network interface 43 that are intercommunicated through a system bus. It should be noted that the figure only shows the computer equipment 4 having components 41-43, but it should be understood that it is not required to implement all the components shown, and more or fewer components may be implemented instead. Where, those skilled in the art can understand that the computer equipment here is a device that can automatically perform numerical calculations and/or information processing according to pre-set or stored instructions, and hardware thereof includes but is not limited to microprocessors, application specific integrated circuits (ASICs), field-programmable gate arrays (FPGAs), digital signal processors (DSPs), embedded devices, etc.

The computer equipment may be a desktop computer, a notebook computer, a handheld computer, a cloud server or other computing devices. The computer equipment can perform human-computer interaction with the user through a keyboard, mouse, remote control, touch pad or voice control device.

The memory 41 includes at least one type of readable storage medium, and the readable storage medium includes a flash memory, a hard disk, a multimedia card, a card-type memory (for example, an SD or DX memory, etc.), a random access memory (RAM), a static random access memory (SRAM), a read-only memory (ROM), an electrically erasable programmable read-only memory (EEPROM), a programmable read-only memory (PROM), a magnetic memory, a magnetic disk, an optical disk, etc. In some embodiments, the memory 41 may be an internal storage unit of the computer equipment 4, such as a hard disk or memory of the computer equipment 4. In other embodiments, the memory 41 may also be an external storage device of the computer equipment 4, such as a plug-in hard disk, a smart media card (SMC), a secure digital (SD) card, a flash card, etc. equipped on the computer equipment 4. Of course, the memory 41 may also include both the internal storage unit of the computer equipment 4 and external storage devices thereof. In this embodiment, the memory 41 is generally used to store an operating system and various application software installed on the computer equipment 4, such as computer-readable instructions of an automatic sensing scoring method for a cornhole game. In addition, the memory 41 may also be used to temporarily store various types of data that have been output or are to be output.

In some embodiments, the processor 42 may be a central processing unit (CPU), a controller, a microcontroller, a microprocessor, or other data processing chips. The processor 42 is generally used to control the overall operation of the computer equipment 4. In this embodiment, the processor 42 is used to execute computer-readable instructions or process data stored in the memory 41, for example, to execute computer-readable instructions of the automatic sensing scoring method for a cornhole game.

The network interface 43 may include a wireless network interface or a wired network interface. The network interface 43 is generally used to establish a communication connection between the computer equipment 4 and other electronic devices.

According to the computer equipment provided by the present disclosure, the infrared light beams are continuously transmitted at the relative position of each of the target holes and received in real time; the signal is amplified and filtered when shielding is detected; and the microprocessor makes a judgment and accumulates the score according to preset mapping rules. Finally, results are output in real time on the digital display screen, which realizes non-contact automatic scoring during a throwing process, thereby effectively avoiding defects of traditional manual scoring which is prone to errors and slow response.

The present disclosure further provides another implementation, namely, providing a computer-readable storage medium, which stores computer-readable instructions therein. The computer-readable instructions may be executed by at least one processor to enable the at least one processor to perform the steps of the automatic sensing scoring method for a cornhole game as described above.

According to the computer-readable storage medium provided by the present disclosure, the infrared light beams are continuously transmitted at the relative position of each of the target holes and received in real time; the signal is amplified and filtered when shielding is detected; and the microprocessor makes a judgment and accumulates the score according to preset mapping rules. Finally, results are output in real time on the digital display screen, which realizes non-contact automatic scoring during a throwing process, thereby effectively avoiding defects of traditional manual scoring which is prone to errors and slow response.

Through the description of the above implementations, those skilled in the art can clearly understand that the above embodiment methods can be implemented by means of software plus a necessary general hardware platform, and of course can also be implemented by hardware, but in many cases the former is a better implementation. Based on this understanding, the technical solution of the present disclosure, or the part that contributes to the prior art, can be embodied in the form of a software product. A computer software product is stored in a storage medium (such as ROM/RAM, magnetic disk, or optical disk), and includes a number of instructions for enabling a terminal device (which may be a mobile phone, computer, server, air conditioner, or network device, etc.) to execute the method described in each embodiment of the present disclosure.

Obviously, the embodiments described above are only part of the embodiments of the present disclosure, rather than all the embodiments. The drawings provide preferred embodiments of the present disclosure, but do not limit the patent scope of the present disclosure. The present disclosure may be implemented in many different forms. On the contrary, the purpose of providing these embodiments is to make the understanding of the disclosure of the present disclosure more thorough and comprehensive. Although the present disclosure has been described in detail with reference to the aforementioned embodiments, it is still possible for those skilled in the art to modify the technical solutions described in the aforementioned specific implementations, or to make equivalent replacements for some of the technical features therein. Any equivalent structure made using the contents of specification and drawings of the present disclosure, directly or indirectly used in other related technical fields, shall also fall within the scope of protection of this patent application.

What is claimed is:

1. An automatic sensing scoring method for a cornhole game, applied to a game board provided with a plurality of target holes, comprising the following steps:

continuously transmitting infrared light beams at relative positions of each of target holes and receiving the infrared light beams in real time;

recording a baseline level in an unshielded state; and updating a shielding judgment threshold regularly to compensate for ambient light changes and control a misjudgment rate within a preset reliability index;

when it is detected that the infrared light beams are shielded, amplifying an electrical signal output by a receiving end through an operational amplifier, and suppressing high-frequency interference through a low-pass filter with a preset cutoff frequency while retaining envelope changes of a shielding event to obtain a scoring trigger signal;

converting, by a microprocessor, the scoring trigger signal into a corresponding score according to a preset "hole-score" mapping table and adding the corresponding score to a cumulative score of a current contestant; and during a preset scoring period, outputting an updated cumulative score in real time through a digital display screen.

2. The automatic sensing scoring method for the cornhole game according to claim 1, wherein a transmitting end and the receiving end of the infrared light beams are fixed by an elastic shock-proof bracket including a rubber shock-absorbing pad and an adjustable optical axis kit to offset an optical axis deviation caused by a throwing impact.

3. The automatic sensing scoring method for the cornhole game according to claim 1, wherein in the step of converting, by the microprocessor, the scoring trigger signal into the corresponding score according to the preset "hole-score" mapping table and adding the score to the cumulative score of the current contestant, when generating the score, the microprocessor further drives a ring LED and/or buzzer according to a preset visual and/or auditory prompt mode to prompt a scoring event.

4. The automatic sensing scoring method for the cornhole game according to claim 1, wherein after the step of during the preset scoring period, outputting the updated cumulative score in real time through the digital display screen, the method further comprises:

sending the cumulative score periodically to a mobile terminal in a form of a Bluetooth Low Energy broadcast packet to support remote statistics and sharing.

5. The automatic sensing scoring method for the cornhole game according to claim 1, wherein, in the step of when it is detected that the infrared light beams are shielded, amplifying the electrical signal output by the receiving end through the operational amplifier, and suppressing the high-frequency interference through the low-pass filter with a preset cutoff frequency while retaining envelope changes of the shielding event to obtain the scoring trigger signal, the method further comprises:

after shielding is detected, writing a corresponding trigger event into a circular queue; and performing circular queue parallel processing on scoring trigger signals of the plurality of target holes, so that an overall scoring delay is kept within a delay range that meets real-time requirements.

6. The automatic sensing scoring method for the cornhole game according to claim 1, wherein the method further comprises:

when it is detected that a battery voltage is lower than a preset threshold, controlling the digital display screen to prompt at a preset flash frequency and suspending a scoring process until a battery is replaced or restored to a normal voltage.

7. Computer equipment, comprising a memory and a processor, wherein the memory stores computer-readable instructions therein, and when executing the computer-readable instructions, the processor implements the steps of the automatic sensing scoring method for the cornhole game as described in claim 1.

8. A non-transitory computer-readable storage medium, wherein the non-transitory computer-readable storage medium stores computer-readable instructions therein, and when executed by a processor, the computer-readable instructions implement the steps of the automatic sensing scoring method for the cornhole game as described in claim 1.

* * * * *